United States Patent [19]

Collins

[11] Patent Number: 4,993,880

[45] Date of Patent: Feb. 19, 1991

[54] TRENCH-BOX PANEL

[75] Inventor: John Collins, St. Albans, England

[73] Assignee: Maybe Hire Company Limited, United Kingdom

[21] Appl. No.: 518,700

[22] Filed: May 3, 1990

[30] Foreign Application Priority Data

May 3, 1989 [GB] United Kingdom ..... 8910100

[51] Int. Cl.[5] ..... E21D 5/00

[52] U.S. Cl. ..... 405/283; 405/272; 405/282

[58] Field of Search ..... 405/272, 274, 276, 277, 405/282, 283, 284; 52/569, 579, 588, 727, 730, 731, 806, 807

[56] References Cited

U.S. PATENT DOCUMENTS

| | | | |
|---|---|---|---|
| 2,878,904 | 3/1959 | Fanner | 52/579 X |
| 2,899,028 | 8/1959 | Walker | 52/579 |
| 3,750,409 | 8/1973 | Orfei | 405/283 |
| 3,999,393 | 12/1976 | Krings | 405/282 |
| 4,044,564 | 8/1977 | Griswold | 405/283 |
| 4,345,857 | 8/1982 | Krings | 405/282 |

FOREIGN PATENT DOCUMENTS

| | | | |
|---|---|---|---|
| 23566 | 2/1981 | European Pat. Off. | 405/282 |
| 2422404 | 11/1975 | Fed. Rep. of Germany | 405/282 |

*Primary Examiner*—Randolph A. Reese
*Assistant Examiner*—John A. Ricci
*Attorney, Agent, or Firm*—Pennie & Edmonds

[57] ABSTRACT

A trench-box panel (200, 202) comprises an array of horizontal elongate "C-section" members (210) one on top of another and welded together at w continuously along their lengths. The members (210) are longitudinally staggered to leave spaces (234) between the ends of alternate members (210) at each side edge (200C, 202C) of the panel (200, 202). Robust vertical angle-members (236) and flat members (238) are welded to the ends of the horizontal members (210) to seal the ends of cavities (220) inside the horizontal members (210).

6 Claims, 9 Drawing Sheets

234
207
202C
214
214
234
248
237
202C
207
239
500b
224
W
W
202B
202A
202B 224
226
222
210
210
210
210
210
210
210
210
210
202
202
207
207
234
214
500b
202C
214
234
248
237
202C
239

TRENCH-BOX PANEL

FIELD OF THE INVENTION

This invention relates to a panel for a trench-box comprising a plurality of such panels inter-connected by extendible and retractable struts.

BACKGROUND OF THE INVENTION

Such a trench-box is used to short up the walls of an excavation.

This invention is one of two inventions which are the subject of two co-pending patent applications both filed on the same day by the present applicant. The other patent application is as follows:

PAT. application No. 07-518,692 entitled "CONNECTION BETWEEN PANELS IN A TRENCH-BOX".

A trench-box panel has to be strong enough to withstand quite severe usage in civil engineering work involving excavation. Quite often, workmen resort to using a mechanical digger to knock a panel into an excavation and to move the panel into position against a wall of the excavation, hitting the panel first on one end and then on the other end of the panel until it is correctly positioned. The struts are extended to force the panel against the wall of an excavation, with a loading which may be as much as 40 $kN/M^2$ (kilonewtons per square meter). A trench-box panel is required to be re-useable in one excavation after another. It is also required to be light enough in weight for transportation and manoeuvering into position on site.

SUMMARY OF THE INVENTION

An object of the invention is to provide a construction of trench-box panel which is strong enough to withstand rough usage in civil engineering work involving excavations.

The invention will be described by way of example with reference to the drawings.

BRIEF DESCRIPTION OF THE DRAWINGS

FIG. 2 is a perspective view of a pair of base panels alone, that is, without the top panels, interconnected by four struts.

DETAILED DESCRIPTION OF PREFERRED EMBODIMENT

Figure 22:
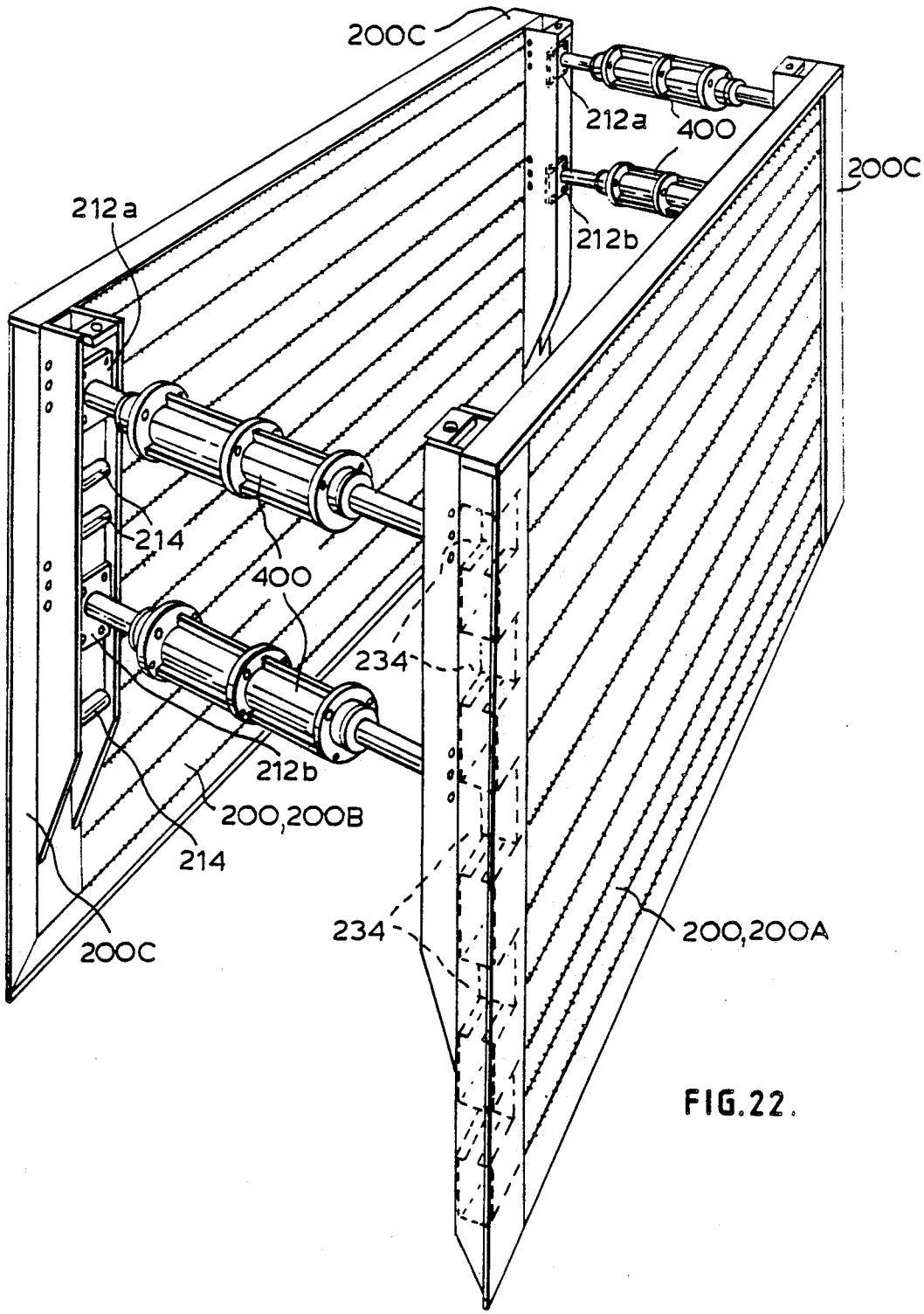

A trench-box embodying the invention comprises a pair of mutually spaced-apart base panels 200 interconnected by extendible and retractable struts 400 and a pair of mutually spaced-apart top panels 202 also interconnected by similar struts 400. (FIG. 22 shows just the base panels 200 with their struts 400.) Each top panel 202 is an upper extension of a respective one of the base panels 200, to which it is firmly and rigidly connected by panel-connecting means 208 (FIGS. 14 and 15) comprising panel-securing means 216 and panel-positioning means 218.

Figures 1, 2:
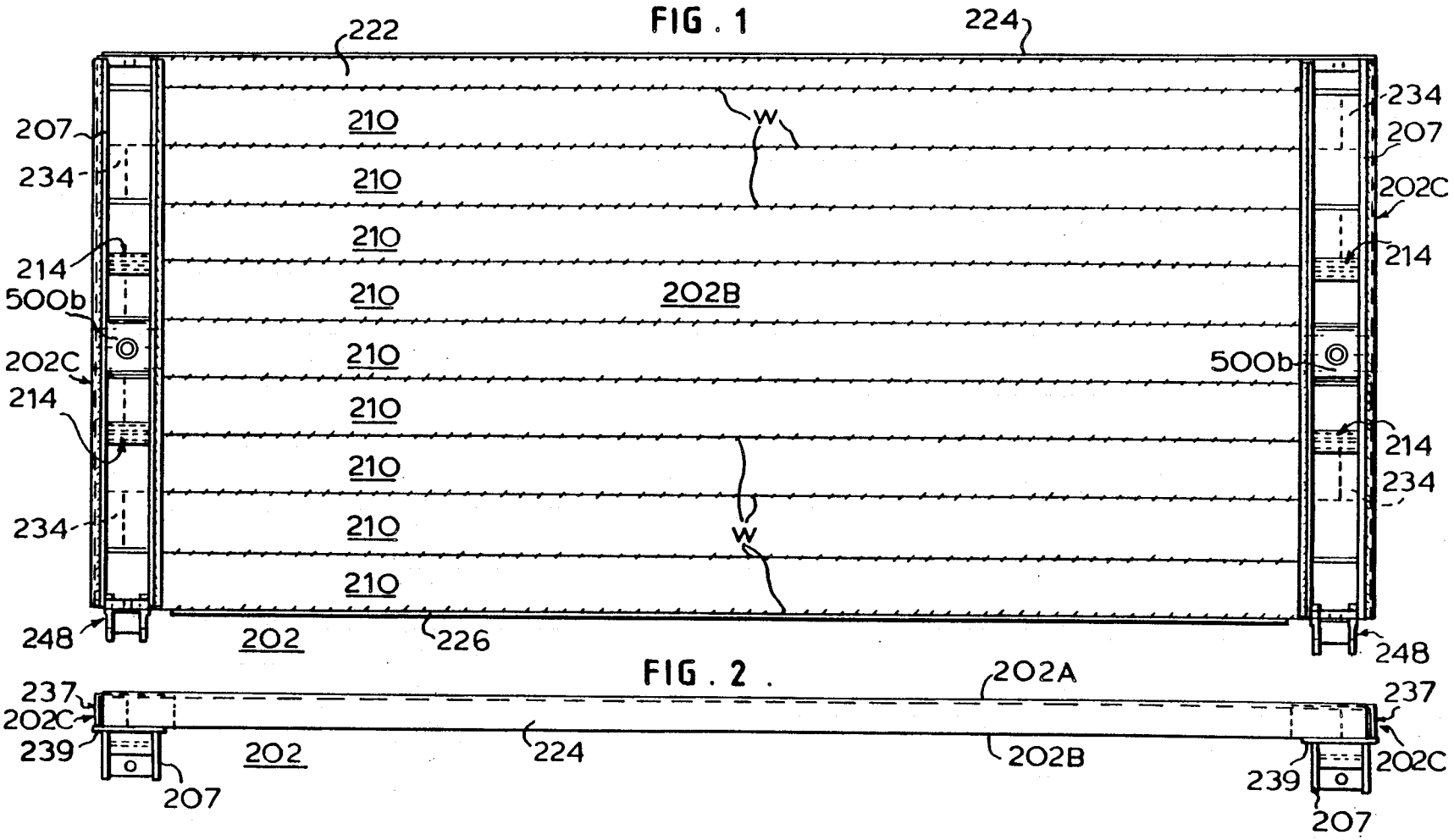
FIG. 1 is an elevational view of the rear face (inner face) of a top panel (upper extension panel) showing two end-posts with leaf-spring end-holders and strut-connectors.
FIG. 2 is a plan view corresponding to FIG. 1.
Figure 3:
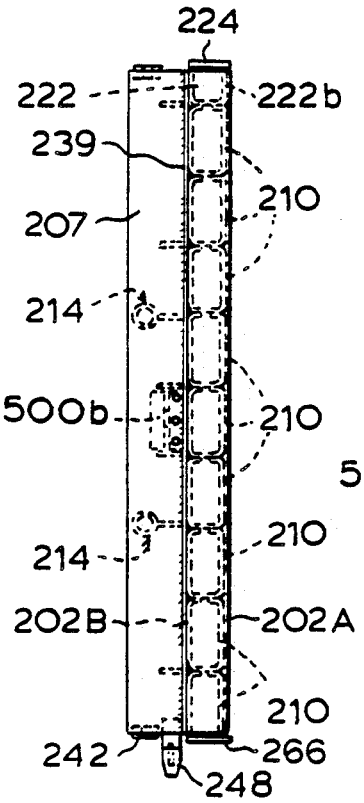
FIG. 3 is an end view corresponding to FIGS. 1 and 2, showing the end-posts with the leaf-spring end-holders and strut-connectors.
Figure 4:
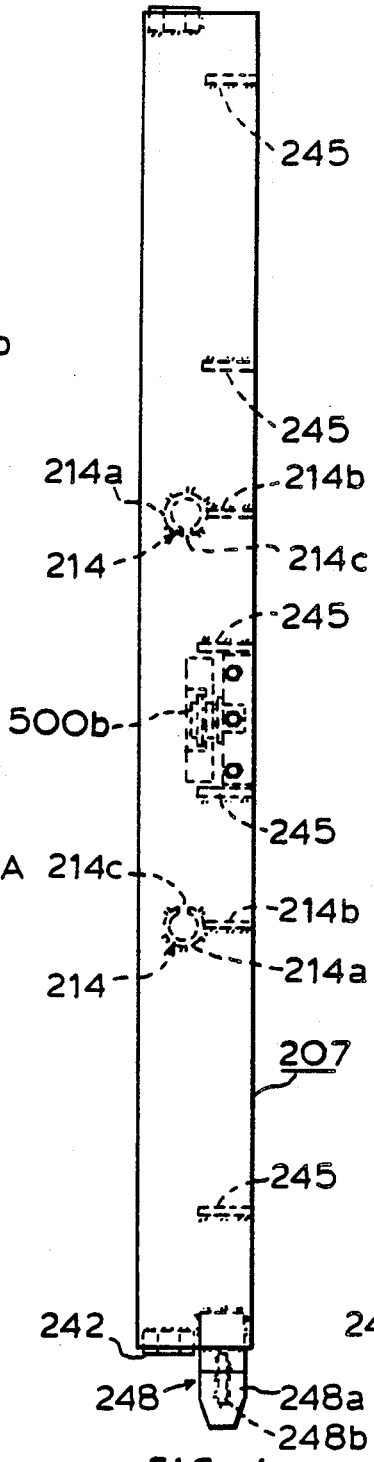
FIG. 4 is an enlarged view of an end-post as seen in FIG. 3.
Figure 5:
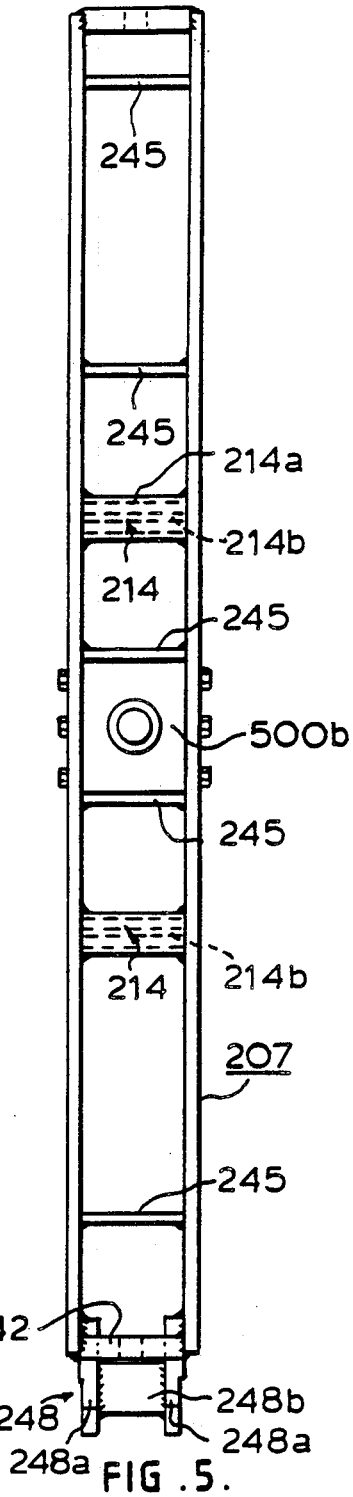
FIG. 5 is an elevational view of the end-post of FIG. 4.
Figure 6:
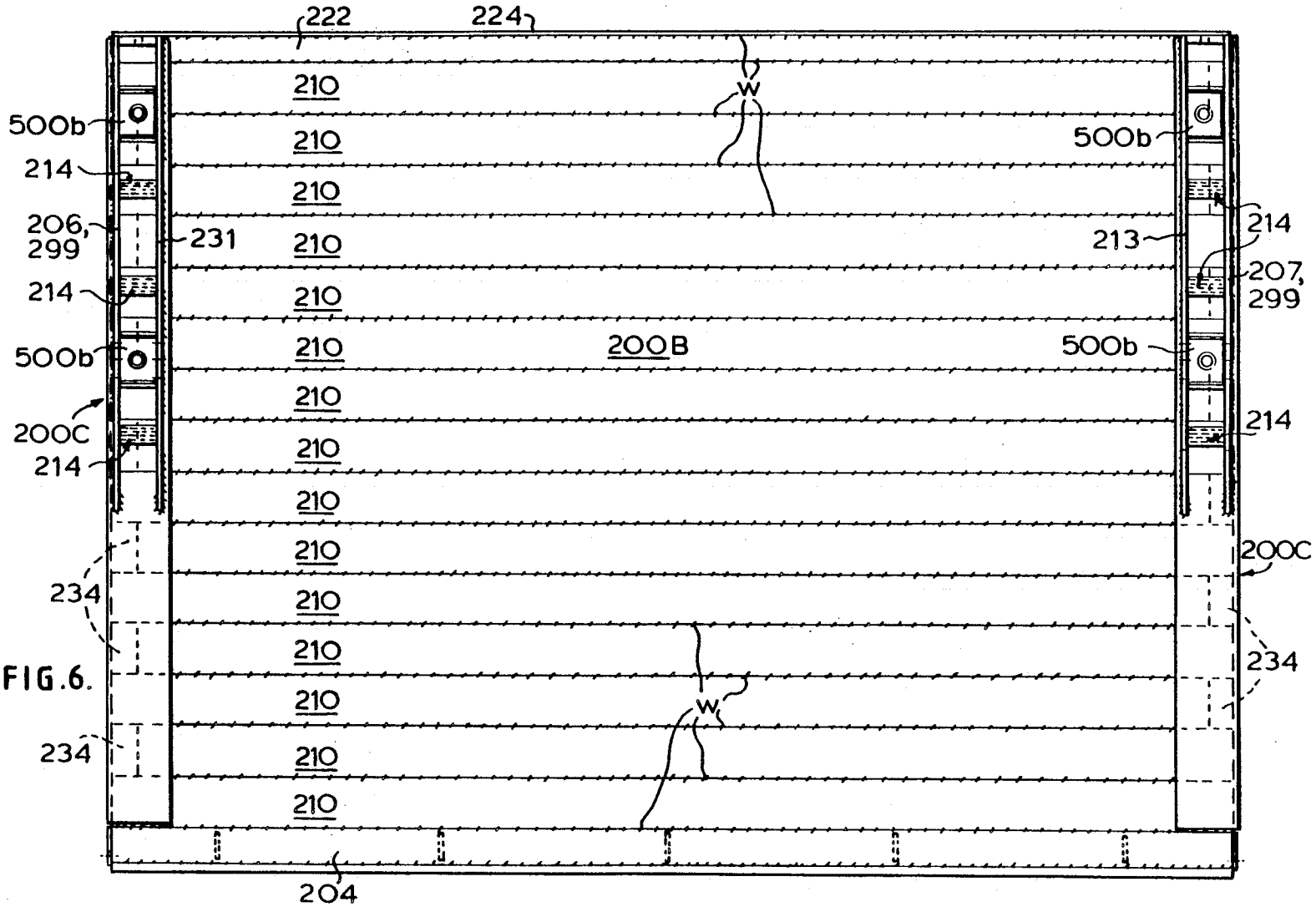
FIG. 6 is an elevational view of the rear face (inner face) of a base panel, showing two end-posts with leaf-spring end-holders and strut-connectors and showing a nose sub-assembly.
Figure 7:
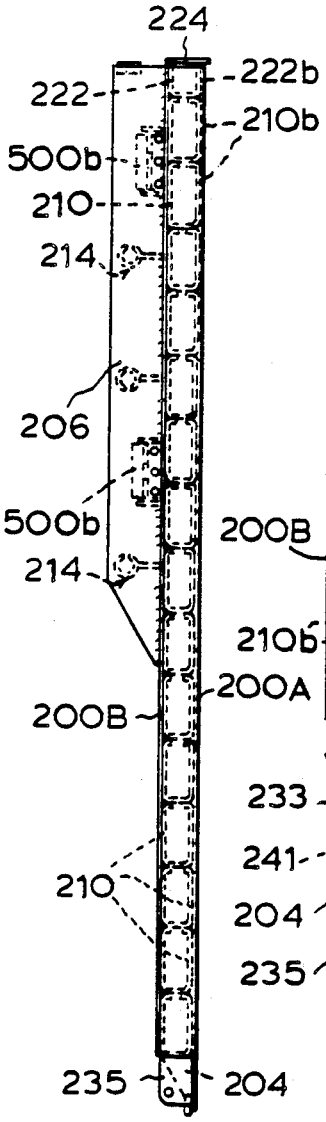
FIG. 7 is an end view corresponding to FIG. 6 and showing the leaf-spring end-holders and strut-connectors.
Figure 11:
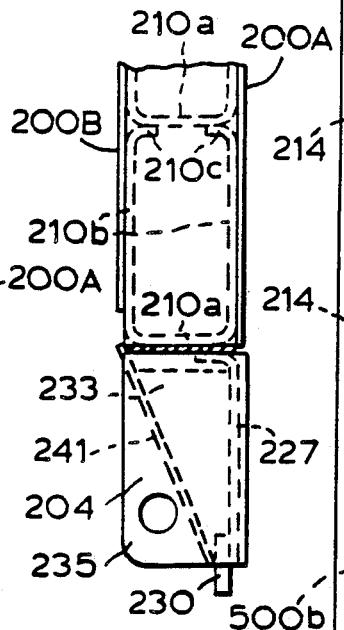
FIG. 11 is an enlarged view as seen in FIG. 7 of the nose sub-assembly.
Figure 9:
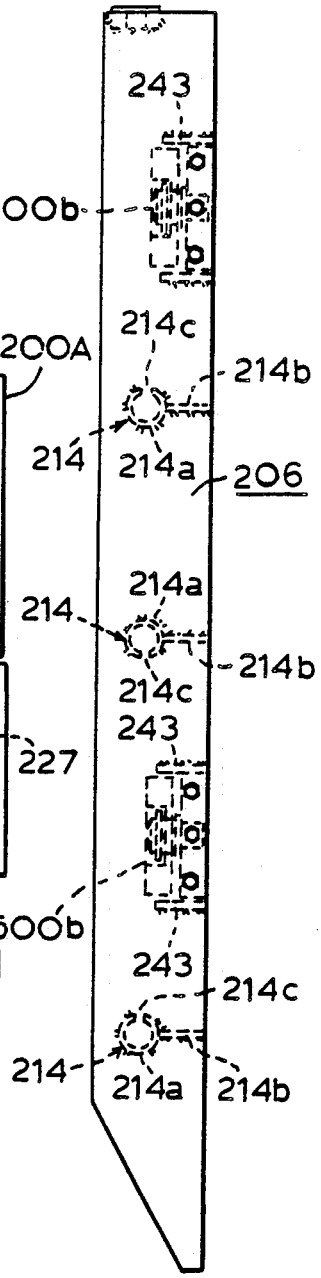
FIG. 9 is an enlarged view as seen in FIG. 7 of an end-post.
Figure 10:
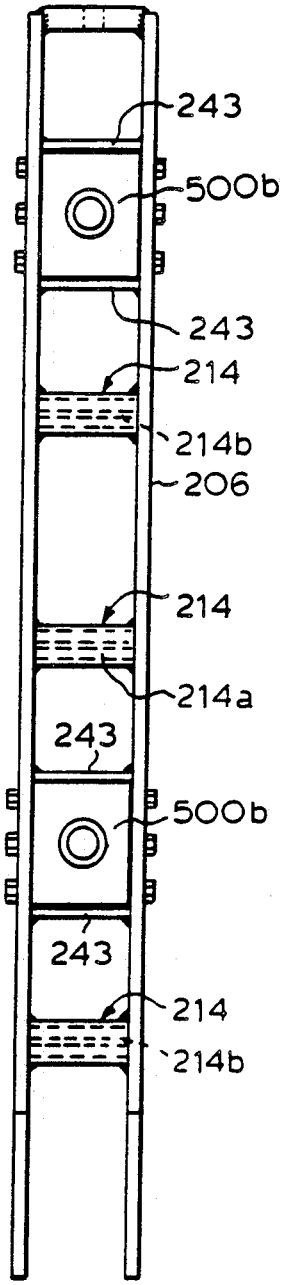
FIG. 10 is an elevational view of the end-post of FIG. 9.
Figure 8:
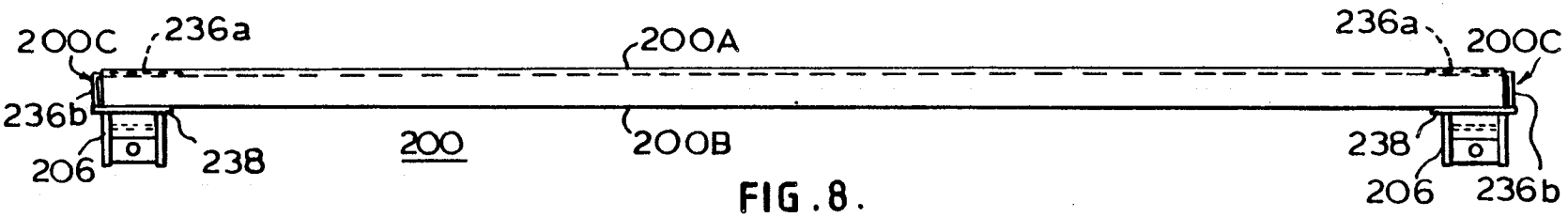
FIG. 8 is a plan view corresponding to FIGS. 6 and 7.
Figure 12:
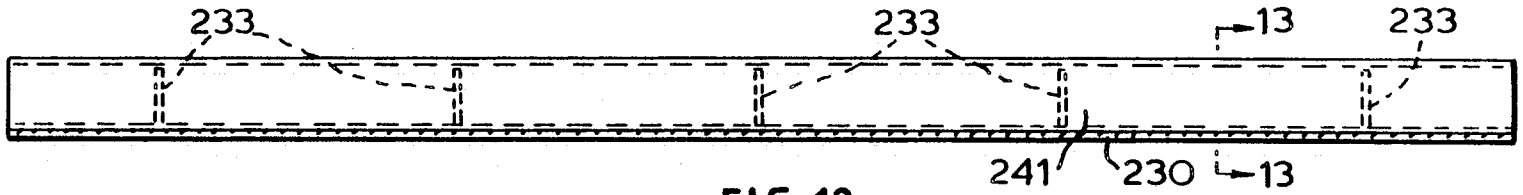
FIG. 12 is an elevational view of the nose sub-assembly alone of FIG. 7.
Figure 13:
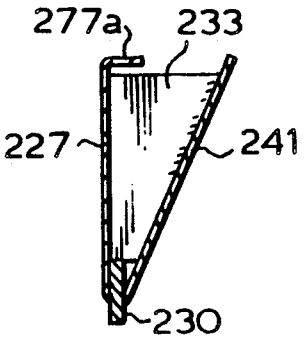
FIG. 13 is a section on 13—13 of FIG. 12.
Figure 20:
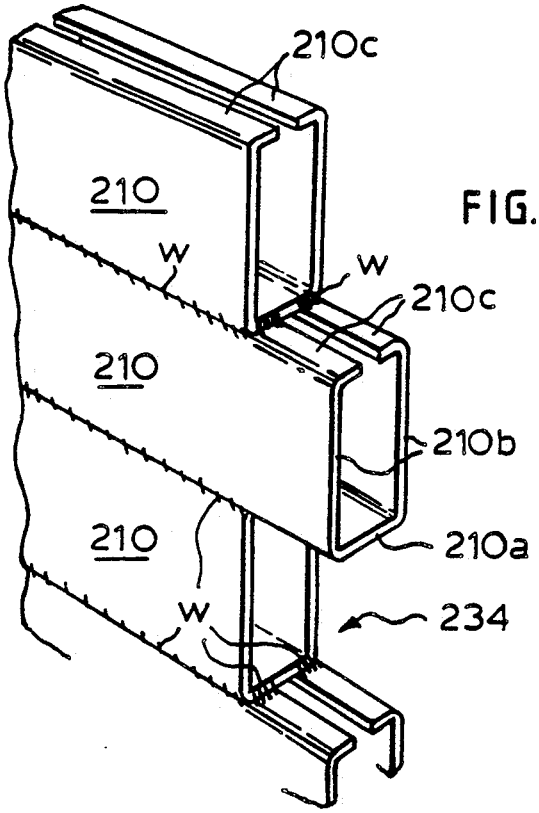
FIG. 20 is a fragmentary perspective view of one side edge of one of the panels before attachment of the vertical angle member and vertical flat member to seal the horizontal cavities formed by the C-section members.

Each base panel 200 (FIGS. 6 to 13) and each top panel 202 (FIGS. 1 to 5) comprises an array of respective horizontal elongate "C-section" members 210, one on top of another and welded together. Each such horizontal C-section member 210 (see FIGS. 11 and 20) comprises a horizontal base element **210*a*, a pair of mutually-facing vertical elements 210*b*, which respectively extend upwardly from inside and outside edges of the horizontal base element 210*a*, and a pair of flange elements 210*c* which extend inwardly towards each other from respective upper edges of the vertical elements 210*b*. Each horizontal C-section member 210 is arranged with its horizontal base element 210*a* lowermost and its flange elements 210*c* uppermost, so that adjacent horizontal C-section members 210 have the horizontal base element 210*a* of the upper C-section member 210 resting on, and welded at w to, the flange elements 210*c* of the lower C-section member 210, the welding w being continuous along their lengths, to define a horizontally-extending cavity 220. The cavity 220 is closed by the elements 210*a*, 210*b* and 210*c* except at the ends of the cavity 220**.

Figure 16:
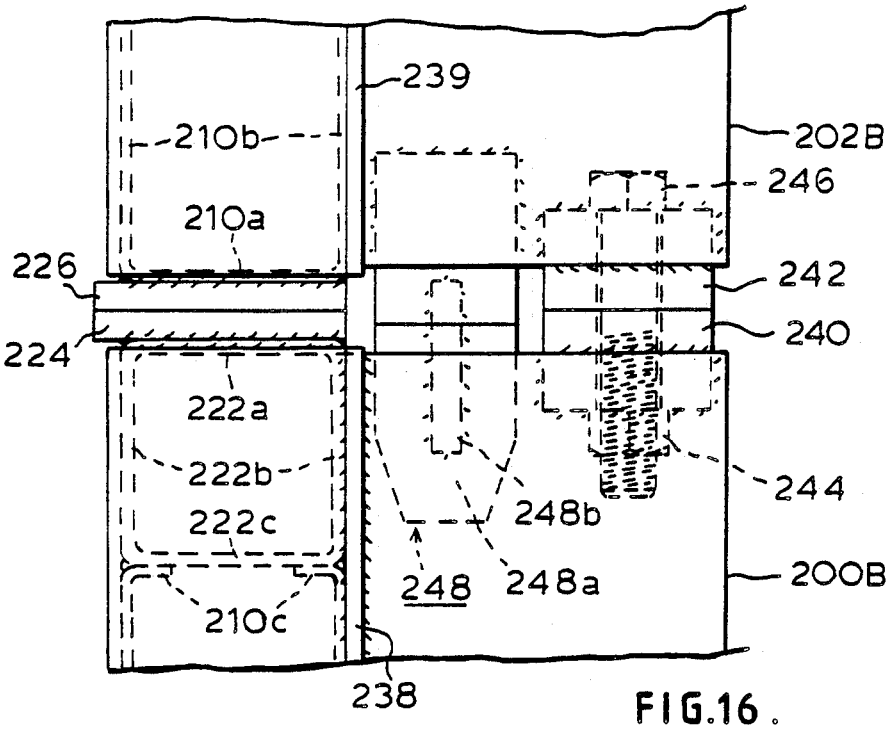
FIG. 16 is a view on arrow 16 in FIG. 14.

Each base panel 200 and each top panel 202 also comprises a respective horizontal box-section member 222 resting upon, and welded at w continuously along its length to the flange elements **210*c* of the uppermost horizontal C-section member 210. A respective robust flat member 224 is welded at w continuously along its length to the top element 222***a* of the box-section member 222 of each panel 200, 202 (see FIG. 16 with respect to panel 200).

The welding w between members 210, 222 and 224 of panels 200 and 202 is illustrated by short hatch lines. Other welding w in panels 200 and 202 is similarly illustrated.

Each base panel 200 and each top panel 202 has a front face 200A, 202A and a rear face 200B, 202B formed by the vertical elements 210*b* of the C-section members 210 and corresponding vertical elements 222*b* of box-section members 222. Each panel 200, 202 also has side edges 200C, 202C formed by the ends of the members 210, 222.

The top panel 202 has a second robust flat member 226 (FIG. 16) welded at w to the underneath of the base element 210*a* of the lowermost horizontal member 210 of the top panel 202.

The base panel 200 has a nose assembly 204, welded at w to the underneath of the base element 210*a* of the lowermost horizontal member 210 of the base panel 200. The nose assembly 204 (FIGS. 12 and 13) is formed by an elongate member 227, a robust nose bar 230, triangular stiffeners 233, end-plates 235 (shown in FIGS. 7 and 11, omitted in FIGS. 12 and 13) and a back-plate 241.

The horizontal C-section and box-section members 210, 222 of the base and top panels 200, 202 are all of a uniform length and are longitudinally staggered so as to leave spaces 234 (FIGS. 1, 6 and 20) between the ends of alternate C-section and box-section members 210, 222 at each side edge 200C, 202C of each panel 200, 202, for a purpose described below. Except for the spaces 234, members 210 and 222 are welded together at w continuously along their entire lengths on both faces 200A (202A) and 200B (202B).

Two vertical, robust angle-members 236 and two vertical, flat members 238 are welded, at the two side edges 200C of panel 200, to the ends of the horizontal C-section and box-section members 210, 222 of the base panel 200, so as to seal the ends of horizontal cavities 220 inside the C-section and box-section members 210, 222 against the intrusion of water, which would otherwise corrode the members and which would also otherwise add considerably to the weight of the panel 200.

Figure 15:
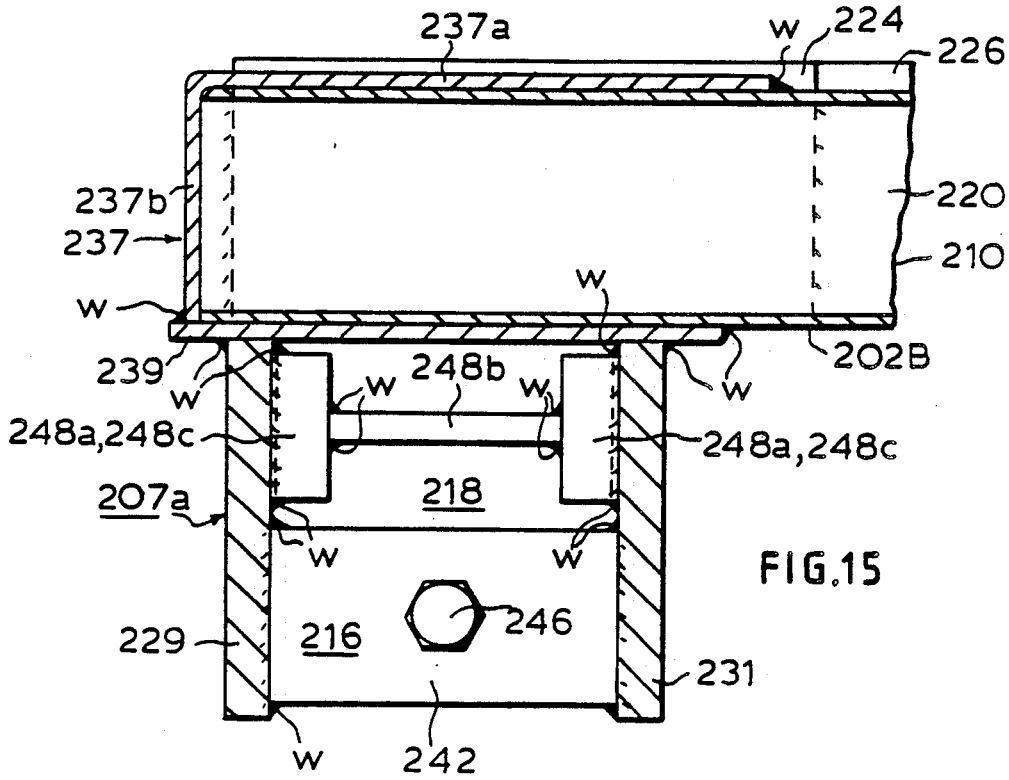
FIG. 15 is a sectional plan view on 15—15 in FIG. 14, showing welded members sealing a horizontal cavity of a C-section member of the top panel.

Similarly, two angle members 237 and two flat members 239 are welded to the ends of members 210, 222 of the top panel 202 at its two side edges 202C. FIG. 15 shows, with respect to the top panel 202, the sealing in this way of the cavity 220 of one C-section member 210 of the top panel 202. The sealing of all the cavities 220 in members 210 and 222 of panels 200 and 202 is effected in the same manner.

Figure 14:
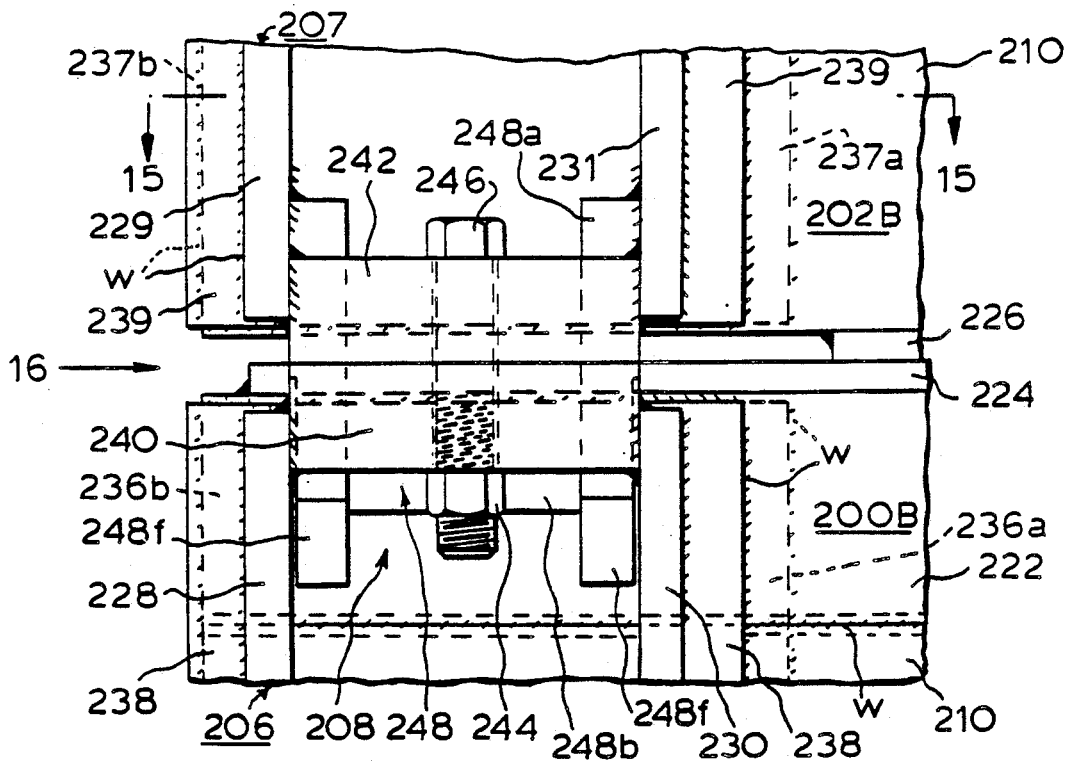
FIG. 14 is an enlarged fragmentary view of adjacent side edges of the top of the base panel and the bottom of the top panel as seen in elevation from the rear, that is, the same directions as FIGS. 1 and 6, showing the two panels connected together.

Each angle member 236 (237) has one wider element 236*a* (237*a*) and one, perpendicular, narrower element 236*b* (237*b*). The wider element 236*a* (237*a*) covers parts of the members 210, 222 on the front face 200A (202A), whilst the narrower element 236*b* (237*b*) extends across the side edges 200C (202C) from the front face 200A (202A) to the back face 200B (202B). Each flat member 238 (239) covers parts of the members 210, 222 on the rear face 200B (202B). Each flat member 238 (239) extends from, and is sealingly welded at w to, a distal edge of the narrower element 236*b* (237*b*) of angle-member 236 (237) and faces the wider element 236*a* (237*a*) thereof, as shown in FIG. 14 for members 237 and 239.

The strength of the panel 200 (202) is enhanced by the fact that some of the welds w between the C-section and box-section members 210, 222, on the one hand and the vertical angle members 236 (237) on the other hand are substantial welds in the spaces 234 between the alternate C-section and box-section members 210, 222 as shown.

Two end-posts 206, 206 are welded to the rear face 200B of the base panel 200 and two similar end-posts 207, 207 are welded to the rear face 202B of the top panel 202. Each end-post 206 (207) comprises two vertical flat members 228, 230 (229, 231) projecting perpendicularly from, and welded at w to, the respective flat member 238 (239), with strengthening webs 243 (245) extending between and welded to the members 228, 230 (229, 231).

A pair of upper strut-connectors 500*b* and a pair of lower strut-connectors 500*b* are secured by bolts and/or welding to the end-posts 206 at the rear face 200B of the base panel sub-assembly 200/5 and a single pair of strut-connectors 500*b* are similarly secured to the end-posts 207 at the rear face 202B of the top panel 202. Each strut-connector 500*b* fits between the vertical members 228, 230 (229, 231) of the end-posts 206 (207). The strut-connectors 500*b* are each designed to be connected to the adjacent end of the respective strut 400 so as to allow the strut to push and pull the base panel or top panel respectively and also to allow the strut to pivot universally, relative to the base panel 200 or top panel 202, up to 5° from the vertical in any direction.

Additionally, leaf-spring end-connectors 214 are welded to the end-posts 206 (207) between the members 228, 230 (229, 231), for connecting the panel 200 (202) to the struts 400 via leaf-springs. Each leaf-spring end-connector 214 comprises a part-cylindrical portion 214*a* and a lateral web 214*b*, welded to each other and to the end-post members 228, 230 (229, 231) and to the vertical flat member 238 (239) of the panel 200 (202). The part-cylindrical portion 214*a* is cylindrical except for a slot 214*c*, either at the top of portion 214*a* to receive the bottom end of a leaf-spring, or at the bottom of portion 214*a* to receive the top end of a leaf-spring, the leaf-spring extending substantially vertically in either case from a strut 400.

The panel-securing means 216 (FIGS. 14 to 16) comprises, firstly, two elements 240, each welded at w to, and extending between, the tops of members 228, 230 of a respective one of the two end-posts 206 of base panel 200. The panel-securing means 216 comprises, secondly, two elements 242, each welded at w to, and extending between, the bottoms of members 229, 231 of a respective one of the two end-posts 207 of the top panel 202. Thirdly, the panel-securing means comprises two nuts 244 and two bolts 246. Each element 240 underlies and abuts one of the elements 242 and is bolted to it by a nut-and-bolt 244, 246.

Figure 17:
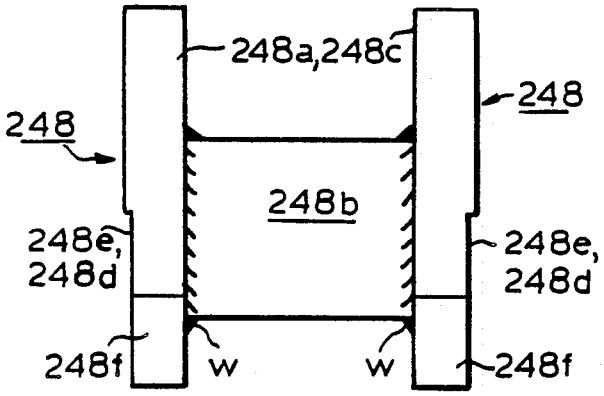
FIGS. 17, 18 and 19 are an elevational view, a side view and a plan view respectively of a peg member shown in FIGS. 14, 15 and 16.
Figure 18:
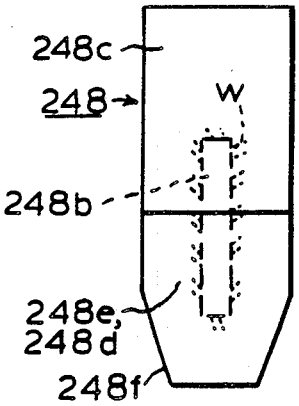
Figure 19:
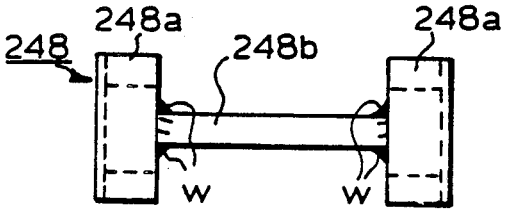

The panel-positioning means 218 comprises two pegs 248, each welded at w to the members 229, 231 of a respective one of the two end-posts 207 of top panel 202 and poking down between the members 228, 230 of end-posts 206 of base panel 200. More particularly, each peg 248 comprises two spaced-apart peg-elements 248*a*, 248*a* connected together by a web 248*b*, which is welded to them both at w as shown in FIGS. 17 and 19. Upper portions 248*c* of peg-elements 248*a* are welded at w to members 229, 231 respectively. Lower portions 248*d* of peg-elements 248*a* are relieved on their faces at 248*e* and also formed with tapered edges at 248*f*, to facilitate entry between members 228, 230 of end-posts 206.

The pegs 248 are located, at shown in FIG. 15, between the elements 240, 242 of the panel-securing means 216 on the one hand and the vertical flat members 238, 239 of panels 200, 202 on the other hand.

The method of making each base panel 200 and top panel 202 is as follows:

A. The C-section members 210 and box-section member 222 of the base panel 200 are laid side-by-side in longitudinally-staggered relationship and are welded together; the welds w (FIG. 16) are between the bottom element 222*c* of the box-section member 222 and the flange elements 210*c* Of the adjacent C-section member 210 and between the adjacent flange elements 210*c* and base element 210*a* of each adjacent pair of C-section members 210. Also, the upper flat member 224 is welded to the top element 222*a* of the box-section member 222. This forms first base panel sub-assembly 200/1.

B. The C-section members 210 and box-section member 222 of the top panel 202 are laid side-by-side and welded together in an identical manner. In the case of the top panel 202, the upper flat member 224 and also the lower flat member 226 are respectively welded to the box-section member 222 and the lowermost C-section member 210. This forms a first top panel sub-assembly 202/1.

C. The angle members 236 (237) are then respectively welded to the ends of the C-section members 210 and box-section members 222 of the base panel 200 (top panel 202) at both side edges 200C (202C) of the panel 200 (202) to form a sub-assembly 200/2 (202/2). At this stage, the spaces 234 are accessible and some of the welds between the C-section members 210 and box-section members 222, on the one hand, and the vertical angle members 236 (237), on the other hand, are substantial welds in the spaces 234, to contribute eventually to the strength of the panel 200 (202). Then the flat members 238 (239) are welded to the C-section members 210 and box-section members 222 and to the angle members 236 (237) to seal the spaces 234 and to seal the cavities 220 inside the C-section and box-section members 210, 222, forming a sub-assembly 200/3 (202/3).

D. Then, separately, a nose subassembly 204/1 is formed by welding the nose bar 230 face-to-face with the elongate member 227 at an edge thereof opposite a flange element 227*a* of member 227, and welding the triangular stiffeners 233 to the elongate member 227 at intervals along the length of the elongate member 227. Then back-plate 241 is welded to the stiffeners 233 and the nose bar 230, forming a nose sub-assembly 204/2 for the base panel sub-assembly 200/3.

E. Then the nose sub-assembly 204/2 is welded to the bottom of the base panel sub-assembly 200/3 to form a new base panel sub-assembly 200/4. At this stage, the ends of the nose sub-assembly 204/2 are still open. Then the end-plates 235 are welded to the ends of the nose subassembly 204/2 to form a base panel sub-assembly 200/5.

F. Then the members 228, 230 of the end-posts 206, 206 are welded to the flat members 238 at the rear face 200B of base panel sub-assembly 200/5 and the members 29, 231 of the two end-posts 207, 207 are welded to the flat members 239 at the rear face 202B of the top panel 202. Also the strut-connectors 500*b* and leaf-spring end-connectors 214 and the webs 243, 245 are welded in. Elements 240 are welded to members 228, 230 of end-posts 206, whilst elements 242 and pegs 248 are welded to members 229, 231 of end-posts 207.

To connect the panels 200, 202 together, they are mutually positioned by means of the panel-positioning means 218 and then the bolts 244 are extended through the aligned holes in elements 240, 242 and the nuts 246 are put on and tightened.

Figure 21:
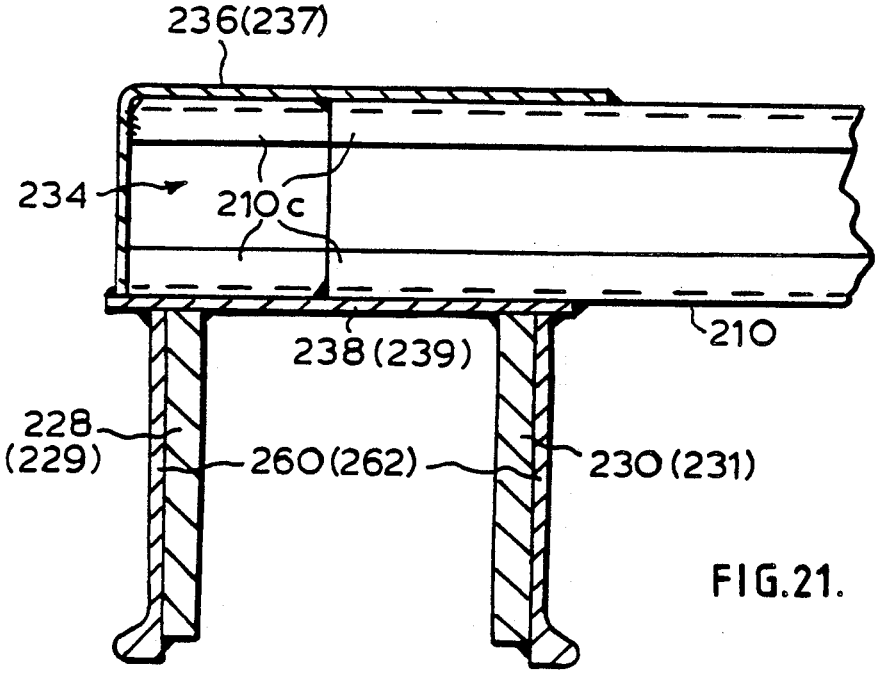
FIG. 21 is a fragmentary plan view of a side edge of a modified panel.

In the modification of FIG. 21 (compare with FIG. 15, except that the panel-connecting means 208 is omitted in FIG. 21) the flat members 228, 230 (229, 231) are backed for extra strength by flat members 260 (262) having strengthening ribs 260*a* (262*a*).

What is claimed and desired to be secured by Letters Patent is:

1. A trench-box panel comprising an array of horizontal members, arranged one on top of another and welded together in mutually adjoining pairs, at least one element of one member of each said pair of mutually adjoining members co-operating with at least one adjoining element of the other member of the pair to define a horizontally-extending cavity which is closed by said elements except at the ends of the cavity, adjacent ends of mutually adjoining members being in mutually staggered relationship to leave spaces between the ends of alternate horizontal members at each of two vertical edges of the panel, and vertical panel-strengthening members welded to said ends of the horizontal members, at both said vertical edges of the panel, by means of welds, so as to seal the ends of said horizontally-extending cavities, some of said welds being welds in said spaces between the horizontal members on the one hand and at least one said vertical member at each said vertical edge of the panel on the other hand.

2. A panel as claimed in claim 1 wherein the horizontal members are of a uniform length and are longitudinally staggered to provide said spaces between the ends.

3. A panel as claimed in claim 1, wherein the vertical members at each said vertical edge of the panel comprise a vertical, two-element, angle member and a vertical flat member which extends from one edge of one said element of the angle member and which faces the other said element of the angle member.

4. A panel as claimed in claim 3 wherein said vertical angle member is said one member welded in said spaces to said horizontal members.

5. A panel as claimed in claim 1, each said horizontal member comprising a horizontal element, a pair of mutually facing vertical elements extending from inside and outside edges of the horizontal element, and a pair of flange elements extending inwardly towards each other from distal edges of the vertical elements, mutually adjacent flange elements and horizontal elements of mutually adjacent members being welded together, and a horizontal closed-section or box-section member welded to the flange elements of a top or bottom one of the first-mentioned horizontal members.

6. A panel as claimed in claim 1 wherein the horizontal members are of a uniform length and are longitudinally staggered to provide said spaces between the ends;

wherein the vertical members at each said vertical edge of the panel comprise a vertical, two-element, angle member and a vertical flat member which extends from one edge of one said element of the angle member and which faces the other said element of the angle member;

wherein said vertical angle member is said one member welded in said spaces to said horizontal members; and each said horizontal member comprising a horizontal element, a pair of mutually facing vertical elements extending from inside and outside edges of the horizontal element, and a pair of flange elements extending inwardly towards each other from distal edges of the vertical elements, mutually adjacent flange elements and horizontal elements of mutually adjacent members being welded together, and a horizontal closed-section or box-section member welded to the flange elements of a top or bottom one of the first-mentioned horizontal members.

* * * * *

UNITED STATES PATENT AND TRADEMARK OFFICE

CERTIFICATE OF CORRECTION

PATENT NO. : 4,993,880

DATED : Feb. 19, 1991

INVENTOR(S) : John Collins

It is certified that error appears in the above-identified patent and that said Letters Patent is hereby corrected as shown below:

On the title page:

Correct item [73] to read:

[73] Assignee: Mabey Hire Company Limited,
United Kingdom

Signed and Sealed this

First Day of September, 1992

*Attest:*

DOUGLAS B. COMER

*Attesting Officer*

*Acting Commissioner of Patents and Trademarks*